US007408117B2

(12) United States Patent
Reibel et al.

(10) Patent No.: US 7,408,117 B2
(45) Date of Patent: Aug. 5, 2008

(54) THREE-DIMENSIONAL MOULDED PLANAR CABLE, METHOD FOR PRODUCTION AND USE THEREOF

(75) Inventors: Denis Reibel, Herrlisheim (FR); Thorsten Frank, Heidelberg (DE)

(73) Assignee: Carl Freudenberg KG, Weinheim (DE)

( * ) Notice: Subject to any disclaimer, the term of this patent is extended or adjusted under 35 U.S.C. 154(b) by 0 days.

(21) Appl. No.: 10/537,082

(22) PCT Filed: Sep. 10, 2003

(86) PCT No.: PCT/DE03/10031

§ 371 (c)(1),
(2), (4) Date: Jan. 20, 2006

(87) PCT Pub. No.: WO2004/051675

PCT Pub. Date: Jun. 17, 2004

(65) Prior Publication Data

US 2006/0131060 A1 Jun. 22, 2006

(30) Foreign Application Priority Data

Dec. 2, 2002 (DE) ..... 102 56 372
Apr. 4, 2003 (DE) ..... 102 15 747

(51) Int. Cl.
*H01B 7/00* (2006.01)

(52) U.S. Cl. ..... 174/117 R; 174/117 F; 174/117 FF

(58) Field of Classification Search ..... 174/36, 174/110 R, 113 R, 117 F, 117 FF
See application file for complete search history.

(56) References Cited

U.S. PATENT DOCUMENTS

| | | | | | |
|---|---|---|---|---|---|
| 3,836,415 | A | | 9/1974 | Hilderbrandt | 156/296 |
| 4,381,420 | A | * | 4/1983 | Elliott et al. | 174/34 |
| 4,616,717 | A | * | 10/1986 | Luetzow | 174/117 F |
| 4,781,601 | A | | 11/1988 | Kuhl et al. | 439/77 |
| 4,924,037 | A | * | 5/1990 | Ainsworth et al. | 174/117 F |
| 5,028,473 | A | | 7/1991 | Vitriol et al. | 428/137 |
| 5,142,105 | A | * | 8/1992 | Kihlken et al. | 174/112 |
| 5,246,061 | A | | 9/1993 | Zalite | 165/10 |
| 5,268,531 | A | * | 12/1993 | Nguyen et al. | 174/36 |
| 5,276,759 | A | * | 1/1994 | Nguyen et al. | 385/114 |
| 5,286,924 | A | * | 2/1994 | Loder et al. | 174/117 F |
| 5,327,513 | A | * | 7/1994 | Nguyen et al. | 385/114 |
| 5,554,825 | A | * | 9/1996 | Parker et al. | 174/117 F |
| 5,659,153 | A | | 8/1997 | Narayan et al. | 174/255 |
| 5,918,365 | A | * | 7/1999 | Uchida et al. | 29/868 |
| 6,272,746 | B1 | * | 8/2001 | Mori | 29/868 |

(Continued)

FOREIGN PATENT DOCUMENTS

DE 196 28 850 1/1997

(Continued)

*Primary Examiner*—William H Mayo, III
(74) *Attorney, Agent, or Firm*—Davidson, Davidson & Kappel, LLC

(57) ABSTRACT

A three-dimensional moulded planar cable, includes a laminate made from at least one conductor track, bonded between two insulation layers and at least one support layer, connected to each other by an adhesive layer. The cable is applied to a positive moulding tool, brought into shape by the application of heat and/or radiation and/or pressure and fixed in the three-dimensional shape thereof by cooling to below the glass temperature $T_g$ of the adhesive layer or by hardening of the adhesive layer.

14 Claims, 1 Drawing Sheet

U.S. PATENT DOCUMENTS

| | | | | |
|---|---|---|---|---|
| 6,392,155 | B1 * | 5/2002 | Shimizu et al. | 174/117 F |
| 6,499,217 | B1 * | 12/2002 | Yamada et al. | 29/848 |
| 6,635,826 | B2 * | 10/2003 | Yamamoto et al. | 174/117 F |
| 6,717,057 | B1 * | 4/2004 | Segall et al. | 174/117 FF |
| 6,948,240 | B2 * | 9/2005 | Hsieh | 29/864 |
| 2004/0031619 | A1 * | 2/2004 | Lettmann et al. | 174/117 F |
| 2006/0131059 | A1 * | 6/2006 | Xu et al. | 174/117 F |

FOREIGN PATENT DOCUMENTS

| | | |
|---|---|---|
| DE | 196 49 972 | 5/1998 |
| EP | 0 590 694 | 4/1994 |
| EP | 0 730 394 A1 | 9/1996 |

* cited by examiner

THREE-DIMENSIONAL MOULDED PLANAR CABLE, METHOD FOR PRODUCTION AND USE THEREOF

BACKGROUND

The present invention relates to a three-dimensionally (3D) shaped flat cable, method for its manufacture and use thereof.

A method for manufacturing a cable harness for vehicles is known from German Patent Application 196 49 972, in which the cables are bonded using a support sheet, provided with plug connectors, and attached to a dimensionally stable substrate. At least some of the cables are non-insulated bunched conductors which, successively and independently from one another, are applied along a predefined track to an insulating support sheet which is provided with an adhesive layer and either an insulating protective sheet is subsequently applied to the support sheet and bonded under pressure with the support sheet, or the support sheet and the applied bunched conductors are coated with a layer of protective lacquer and finally adapted to the contour of the place of installation via trimming. The labor-intensive placing of the conductor tracks and their attachment to the dimensionally stable substrate are disadvantages in this method.

A cable harness and a method for its manufacture are known from German Patent Application 196 28 850. The cable harness has electric cables which are situated in a first resin layer having recesses, the first resin layer being formed in such a way that it runs along a predefined installation track of the electric cables and a second resin layer is fixedly connected to the first resin layer in such a way that it covers at least the recess of the first resin layer and is applied via vacuum forming.

The known approaches have the disadvantage that either the cables must be applied to the surface of the dimensionally stable substrate by hand in a very labor-intensive process, or separate parts must be manufactured, the conductors introduced and fixed in their position using the second resin.

BRIEF SUMMARY OF THE INVENTION

The An object of the present invention is to provide a three-dimensionally shaped flat cable and a method for its manufacture which avoids the disadvantages of the known approaches and which allows in the intermediate step the manufacture of dimensionally stable flat cables which are only placed in their place of installation in a second step.

According to the present invention, a flat cable made of a laminate includes at least one conductor track enclosed between two insulation layers, and at least one support layer, which are connected to one another via an adhesive layer, the laminate being applied to a positive die and shaped by applying heat and pressure and fixed in its three-dimensional shape by cooling to below glass temperature $T_g$ of the adhesive layer or by hardening the adhesive layer. Such a 3D flat cable is also storable as an intermediate part prior to installation. The support layer may be made of metal foils, plastic sheets, or porous layers.

A thermoplastic adhesive, a thermoplastic adhesive foil and/or an adhesive-bonded nonwoven having a melting point $T_m$ of <180° C. and/or a latent reactive adhesive having a cross-linking temperature of <140° C. is/are preferably used as the adhesive layer. Adhesive layers of this type make it possible to fixedly bond the flat cable layer to the support layer and to shape them into an intermediate molded part. Cross-linking temperatures of >140° C. may also be used when damage is impossible due to cooling of the conductor track layer. Cooling may be omitted when reactive adhesives are used; however, appropriate strengthening must have occurred in this case via extensive hardening by cross-linking.

Moreover, another porous layer for covering may be provided for better handling. The porous layer is advantageously made of a nonwoven or a fabric of polymer fibers.

The flat cable according to the present invention may at least partially be back-coated using a thermoplast. This makes it possible to manufacture parts shaped in the place of installation.

The conductors of the conductor track are advantageously exposed at least in partial sections of their surface prior to lamination for forming contact fields.

Particularly preferred is a flat cable which is fitted with electronic components. This makes it possible to manufacture operationally ready-for-use electronic built-in components in a very economical manner.

Manufacturing of the 3D flat cables as intermediate parts takes place in such a way that the laminate composed of flat cable, adhesive, and nonwoven layers is applied to a positive die, adjusted, and shaped by applying heat and/or radiation and/or pressure and fixed in its shape by cooling to below the glass transition temperature $T_g$ of the adhesive layer or by hardening the adhesive layer. A partial vacuum is applied to the backside of the laminate as the pressure, for example.

The laminate parts, fixed in shape, are preferably remachined by stamping, milling, or cutting and are, in a separate step, installed in their place of installation or are, for better assembly, at least partially back-coated in an injection molding process using a thermoplast.

For equalizing the temperature, a metal foil is preferably used during the laminating process and/or in the die.

BRIEF DESCRIPTION OF THE DRAWINGS

Nonwovens made of polyester or polyamide which have a thickness of 0.1 mm to 2 mm, a tensile strength of 50 to 250 N/50 mm, and an elongation of 30% to 50% are preferably used for the aforementioned method. The adhesive nonwoven used as the thermoplastic adhesive layer should have a softening point between 30° C. and 180° C., its mass per unit area should be between 10 g/m$^2$ and 70 g/m$^2$, and it should have a low melt index.

DETAILED DESCRIPTION OF A PREFERRED EMBODIMENT

Figure 1:
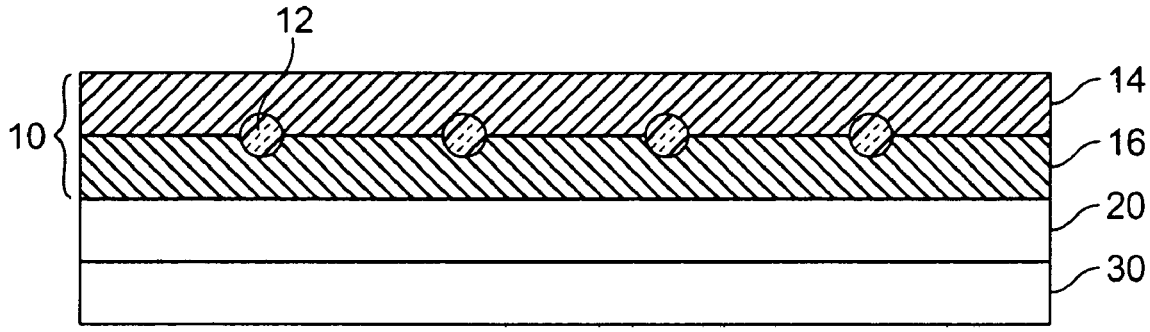

The present invention is subsequently explained in greater detail based on FIG. 1 and the examples.

EXAMPLE 1

FIG. 1 shows a three-dimensionally shaped flat cable includes a laminate including (a) at least one conductor track 12 enclosed between two insulation layers 14, 16 thus defining a flexible flat cable, FFC 10, (b) an adhesive layer 20, and (c) at least one support layer 30.

Flexible flat cables (FFC), 1.2 mm to 1.4 mm thick, spunbonded nonwoven made of copolyamides having a $T_m$ of 105° C. to 110° C. and a mass per unit area of 30 g/m$^2$, and adhesive-bonded nonwoven made of polyethylene terephthalate having a mass per unit area of 250 g/m$^2$ are used as material. Using a melting adhesive, a nonwoven is laminated onto the backside of an FFC at 140° C. with the aid of an ironing press. The nonwoven is used as the support layer and the melting adhesive improves the formability. This laminate is fixed on a positive die and is shaped at 140° C./30 s. After the tool has cooled down, the laminate is removed from the mold as a dimensionally stable flat cable.

EXAMPLE 2

As in example 1, a flexible flat cable including 45 g/m$^2$ of a copolyamide having a melting point $T_m$ of 105° C. and an adhesive-bonded staple fiber nonwoven made of polyethylene terephthalate fibers having a mass per unit area of 100 g/m$^2$ are laminated together using a 0.5 mm thick aluminum foil as a cooling element and fixed on a positive die at 140° C./45 s. After the tool has cooled down, the laminate is removed from the mold as a dimensionally stable flat cable.

EXAMPLE 3

As in example 1, a flexible flat cable including an ultraviolet light (UV)-hardening adhesive and an adhesive-bonded nonwoven made of polyethylene terephthalate fibers having a mass per unit area of 150 g/m$^2$ are laminated together. Shaping takes place on a positive die at room temperature under UV light irradiation. After hardening, the laminate is removed from the mold as a dimensionally stable flat cable. The dimensionally stable flat cable is subsequently partially back-coated in an injection molding process using polypropylene.

EXAMPLE 4

As in example 1, a flexible flat cable, which is fitted with electronic components such as light-emitting diodes (LED), including 25 g/m$^2$ of a copolyamide having a melting point $T_m$ of 105° C. and an adhesive-bonded nonwoven made of polyethylene terephthalate fibers having a mass per unit area of 150 g/m$^2$ are laminated together and fixed on a positive die at 110° C./120 s. After the tool has cooled down, the laminate is removed from the mold as a dimensionally stable flat cable.

Additional examples are shown in the following tables.

| | Example | | | | |
|---|---|---|---|---|---|
| | 5 | 6 | 7 | 8 | 9 |
| FFC | PET/Cu | PET/Cu | PET/Cu | PET/Cu | PET/Cu |
| Adhesive | Copolyamide Tm 105° C. 25 g/m$^2$ | Copolyamide Tm 105° C. 25 g/m$^2$ | Copolyamide Tm 105° C. 25 g/m$^2$ | Copolyamide Tm 105° C. 25 g/m$^2$ | Copolyamide Tm 105° C. 45 g/m$^2$ |
| Support | 250 g/m$^2$ PET Nonwoven heat-bonded | 250 g/m$^2$ PET Nonwoven heat-bonded | 250 g/m$^2$ PET Nonwoven chemically bonded | 250 g/m$^2$ PET Nonwoven chemically bonded | 100 g/m$^2$ PET Staple fiber nonwoven heat-bonded |
| Laminating temperature | 130° C. | 130° C. | 130° C. | 130° C. | 120° C. |
| Aluminum | no | yes | no | yes | no |
| Shaping temperature/time | 140° C./30 s | 160° C./60 s | 160° C./60 s | 160° C./30 s | 115° C./120 s |
| Pressure | yes | yes | yes | yes | yes |

| | Example | | | | |
|---|---|---|---|---|---|
| | 10 | 11 | 12 | 13 | 14 |
| FFC | PET/Cu | PET/Cu | PEN/Cu | PET/Cu/LEDs | Pl/Cu |
| Adhesive | Copolyamide Tm 105° C. 15 g/m$^2$ | EVA Tm 80° C. | UV Cross-linking system | Copolyamide Tm 105° C. 25 g/m$^2$ | 25 g/m$^2$ Epoxide/ Copolyamide |
| Support | 100 g/m$^2$ Nonwoven glass fiber | PP 15 g/m$^2$ Staple fiber nonwoven heat-bonded | 150 g/m$^2$ PET Nonwoven heat-bonded | 150 g/m$^2$ PET Nonwoven heat-bonded | 130 g/m$^2$ PET/PA Nonwoven water jet bonded |
| Laminating temperature | 120° C. | 95° C. | RT | 110° C. | 120° C. |
| Aluminum | no | no | no | no | no |
| Shaping temperature/time | 145° C./120 s | 110° C./180 s | Room temperature | 120° C./120 s | 180° C./10 s |
| Pressure | yes | yes | yes | yes | no |

| | Example | | | |
|---|---|---|---|---|
| | 15 | 16 | 17 | 18 |
| FFC | PEN/Cu | PEN/Cu | PEN/Cu | PEN/Cu |
| Adhesive | Copolyamide Tm 105° C. 500 g/m$^2$ | Copolyamide sheet (Texiron 199 protechnic) Tm 105° C. 450 g/m$^2$ | Copolyamide sheet (Texiron 199 protechnic) Tm 105° C. 450 g/m$^2$ | Copolyester Tm 115° C. Hotmelt 450 g/m$^2$ |

-continued

| | | | | |
|---|---|---|---|---|
| Support | 250 g/m$^2$ PET Nonwoven heat-bonded | 180 μm Aluminum foil | 180 μm PET sheet | 250 g/m$^2$ PET Nonwoven chemically bonded |
| Laminating temperature | 140° C. | 140° C. | 140° C. | 140° C. |
| Aluminum | no | yes | no | no |
| Shaping temperature/time | 140° C./300 s | 140° C./60 s | 140° C./60 s | 140° C./60 s |
| Pressure | yes | yes | yes | yes |

What is claimed is:

1. A three-dimensionally shaped flat cable comprising:

a laminate including at least one conductor track enclosed between two insulation layers, an adhesive layer, and at least one support layer, the support layer connected to at least one of the insulation layers via the adhesive layer, the laminate being applied to a positive die and shaped by applying one of heat, radiation and pressure and fixed in a three-dimensional shape by cooling to below the glass transition temperature of the adhesive layer or by hardening the adhesive layer.

2. The flat cable as recited in claim 1 wherein the support layer is made of a metal foil or a plastic sheet.

3. The flat cable as recited in claim 1 wherein the support layer is a porous layer.

4. The flat cable as recited in claim 3 wherein an additional porous layer is provided for covering for better handling.

5. The flat cable as recited in claim 4 wherein the porous layer is made of a nonwoven or a fabric of polymer fibers.

6. The flat cable as recited claim 1 wherein the adhesive layer is composed of an at least one of thermoplastic adhesive, an adhesive foil and an adhesive-bonded nonwoven having a melting point $T_m$ of <180° C. or a latent reactive adhesive having a cross-linking temperature of <140° C.

7. The flat cable as recited claim 1 wherein the flat cable is at least partially back-coated using a thermoplastic.

8. The flat cable as recited claim 1 wherein the conductors of the conductor track are exposed at least in partial sections of their surface prior to lamination for forming contact fields.

9. The flat cable as recited in claim 1 wherein the flat cable is fitted with electronic components.

10. A method for manufacturing a dimensionally stable flat cable comprising:

applying to a positive die, adjusted at room temperature, a laminate, the laminate including (a) a conductor track enclosed between two insulation layers, (b) an adhesive layer, and (c) a support layer connected to at least one of the insulation layers via the adhesive layer, each of (a), (b) and (c) defining a laminate component, or applying a positive die separately to all components for the laminate, and shaping the laminate or the components with the aid of at least one of heat, radiation and pressure; and fixing the laminate or the component shape by cooling to below the glass transition temperature $T_g$ of the adhesive layer or by hardening the adhesive layer.

11. The method as recited in claim 10 wherein for equalizing the temperature, a metal foil is used during the laminating process and/or in the die.

12. The method as recited in claim 10 wherein the laminate components, fixed in their shape, are installed in a separate step or are back-coated in an injection molding process using a thermoplastic.

13. A three-dimensionally shaped flat cable comprising:

a laminate including a flexible flat cable, an adhesive layer, and at least one support layer, the support layer connected to the flexible flat cable via the adhesive layer, the laminate being applied to a positive die and shaped by applying one of heat, radiation and pressure and fixed in a three-dimensional shape by cooling to below the glass transition temperature of the adhesive layer or by hardening the adhesive layer.

14. The flat cable as recited in claim 1 wherein the laminate is fixed with respect to the die.

* * * * *